United States Patent [19]

Meade, II

[11] Patent Number: 4,979,249

[45] Date of Patent: Dec. 25, 1990

[54] INFLATABLE PILLOW HAVING CONTROLLED DEFLATION

[76] Inventor: Carson H. Meade, II, 320 Mathis Dr., Daniels, W. Va. 25832

[21] Appl. No.: 478,447

[22] Filed: Feb. 12, 1990

[51] Int. Cl.[5] ..... A47G 9/00

[52] U.S. Cl. ..... 5/441; 5/454

[58] Field of Search ..... 5/61, 441, 449, 450, 5/453, 454

[56] References Cited

U.S. PATENT DOCUMENTS

| | | | |
|---|---|---|---|
| 795,108 | 7/1905 | Doellinger | 5/441 |
| 918,391 | 4/1909 | Taarud | 5/441 |
| 2,462,215 | 2/1949 | Norman et al. | 5/441 |
| 2,686,006 | 8/1954 | Hasselquist | 5/454 X |
| 3,477,071 | 11/1969 | Emerson | 5/61 |
| 4,133,064 | 1/1979 | Petrusek . | |
| 4,142,263 | 3/1979 | Pierson | 5/68 |
| 4,161,794 | 7/1979 | Darnfors | 5/441 |
| 4,768,247 | 9/1988 | Beier | 5/434 |
| 4,796,948 | 1/1989 | Paul et al. | 5/453 X |

*Primary Examiner*—Michael F. Trettel
*Attorney, Agent, or Firm*—Donald J. Breh

[57] ABSTRACT

An inflatable cushion in the form of a pillow including an inflatable bladder having a hand operated air pump for inflating the bladder and an adjustable valve providing for a controlled rate of escape of air from the bladder and thus providing for a controlled rate of deflation of the bladder.

11 Claims, 2 Drawing Sheets

INFLATABLE PILLOW HAVING CONTROLLED DEFLATION

BACKGROUND OF THE INVENTION

This invention relates to inflatable cushions. More particularly, the invention relates to an inflatable pillow and, in still greater particularity, to an inflatable pillow having an adjustable rate of deflation.

Inflatable cushions, including pillows, for supporting various parts of a person's body are known including those shown in U.S. Pat. Nos. 4,133,064; 4,142,263; 4,161,794 and 4,768,247. All of these devices include some sort of flexible or expandable bladder or container into which air is introduced to inflate the device to a desired shape and stiffness however, none of these devices provide for deflating the device at a controlled rate. It is known that, for sleeping purposes, it is anatomically desirable not to sleep with a pillow beneath the person's neck or head however, most person's find such position uncomfortable when awake and prefer to have a pillow beneath their head at least prior to sleeping. Even though a person may desire to sleep without a pillow beneath their head, prior to sleeping, many persons desire to relax by reading or watching television which can only be done comfortably with the person's head slightly elevated and positioned comfortably against a pillow. As noted, most persons are more comfortable with a pillow beneath their head and they find it easier to fall asleep in such position, however, as noted, once asleep, it is anatomically preferrable that the person's body lie substantially flat with nothing under their head but, of course, they cannot remove any pillow once they are asleep.

Accordingly, it is the primary object of the present invention to provide for an inflatable pillow which may be inflated to a desired position prior to sleeping so that a person may lie with their head comfortably elevated as desired while advantageously providing for a controlled rate of deflation whereby, the person's head will assume a reclined and physically preferred position when asleep.

SUMMARY OF THE INVENTION

According to the present invention, there is provided an inflatable cushion having an inflatable bladder and means for providing for a controlled rate of deflation of the bladder.

According to a preferred embodiment, the means providing for the controlled rate of deflation of the bladder includes an adjustable valve associated with an inlet into the bladder.

According to the preferred embodiment, the inflatable bladder is connected to a hand operated pump for inflating the bladder to the desired hardness and the adjustable valve is located in an outlet from the hand operated pump.

According to another embodiment of the invention, an auxiliary air tube is provided which allows the user to inflate the device by blowing air through the auxiliary tube independantly of the hand operated pump.

BRIEF DESCRIPTION OF THE DRAWINGS

The invention will be better understood after reading the following Detailed Description of the Preferred Embodiment in conjunction with the drawings in which.

DETAILED DESCRIPTION OF THE PREFERRED EMBODIMENT

Figure 1:
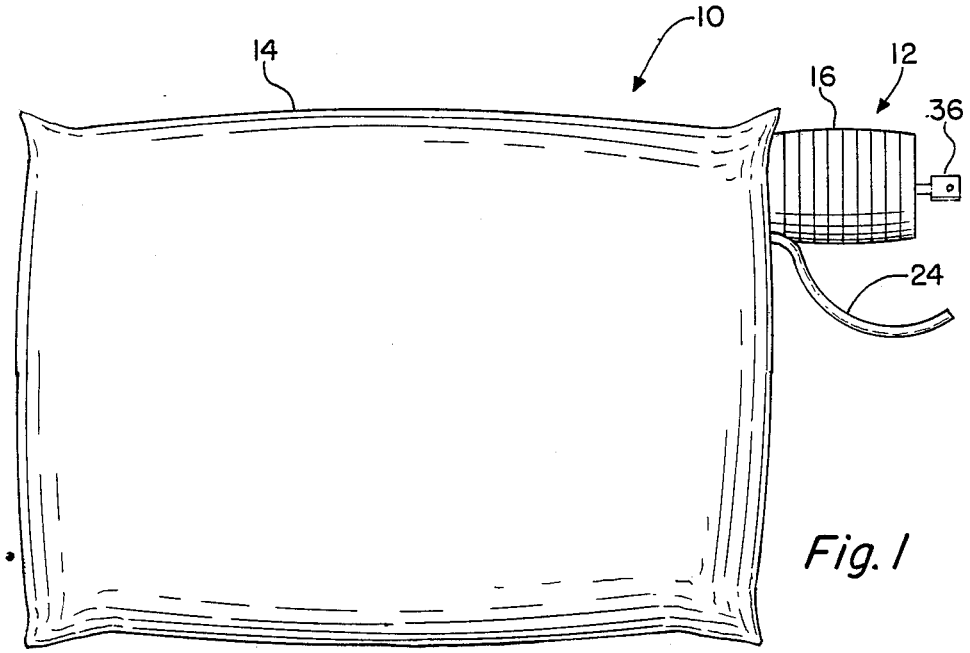
FIG. 1 is a pictorial view of a bladder in the form of a pillow having a hand operated pump, adjustable valve and auxiliary inflation tube according to the invention.
Figure 2:
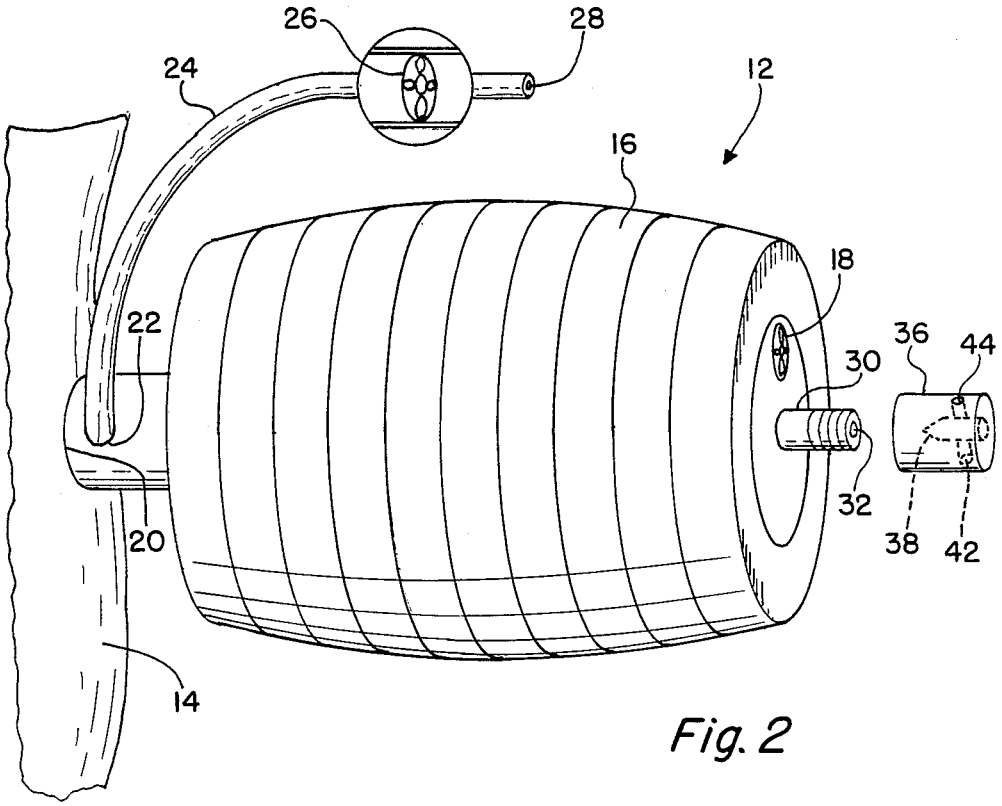
FIG. 2 is an enlarged view of the hand operated pump showing the adjustable valve and auxiliary inflation tube connected to the inflatable cushion.

Shown in FIG. 1 is an inflatable cushion 10 including an inflatable bladder 14 in the form of a pillow. Although the device is shown as being in the form of a pillow, other cushion shapes are possible and the invention is not to be considered limited strictly to an inflatable pillow. A hand operated pump 16 in the form of a bellows or other squeezable closed container communicates with the interior of the bladder 14 through an inlet 20, as shown in FIG. 2. In the embodiment shown, one end of the hand operated pump can be provided with a check valve 18 providing for entry of ambient air into the interior of the pump and for preventing discharge of air when the pump 16 is squeezed or when air is blown from the user's mouth through the auxiliary inflation tube 24 as noted below.

The auxiliary inflation tube 24 includes an outlet 22 which is connected to the inlet 20 into the bladder 14 and an inlet 28 into which air may be blown by the user. As shown in FIG. 2, a check valve 26 is provided in the auxiliarly inflation tube 24 which operates in a well known manner to allow air to pass through the auxiliary tube 24 from the inlet 28 to the outlet 22 and prevents a reverse flow or escape of air out the auxiliary tube when the bladder is inflated or when the hand operated pump 16 is used.

Figure 3:
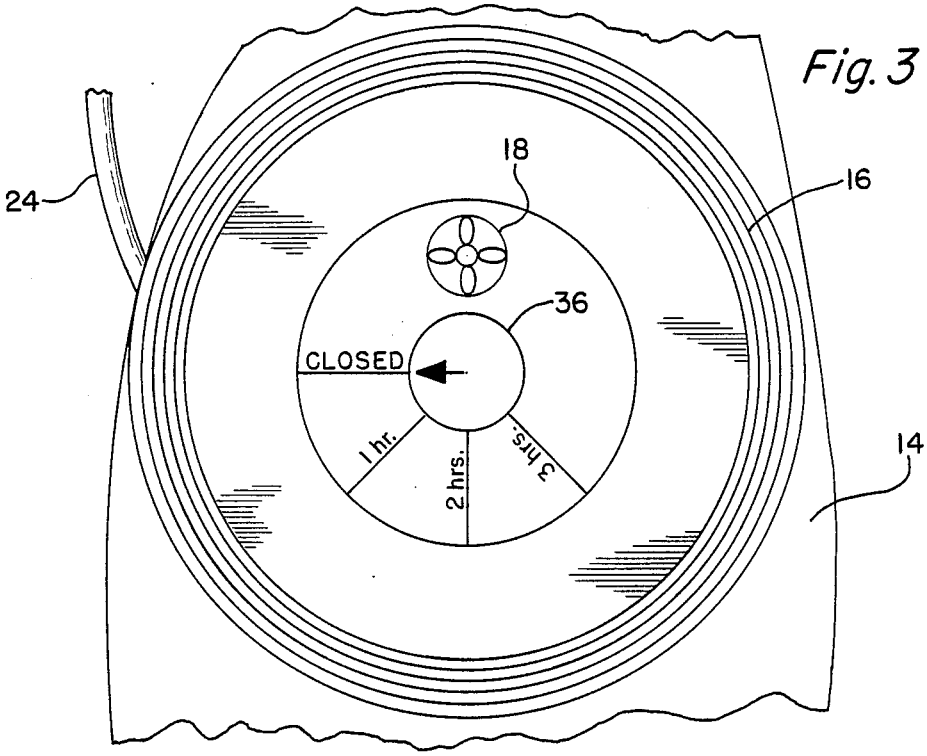
FIG. 3 is an end view of the hand operated pump in FIG. 2.
Figure 4:
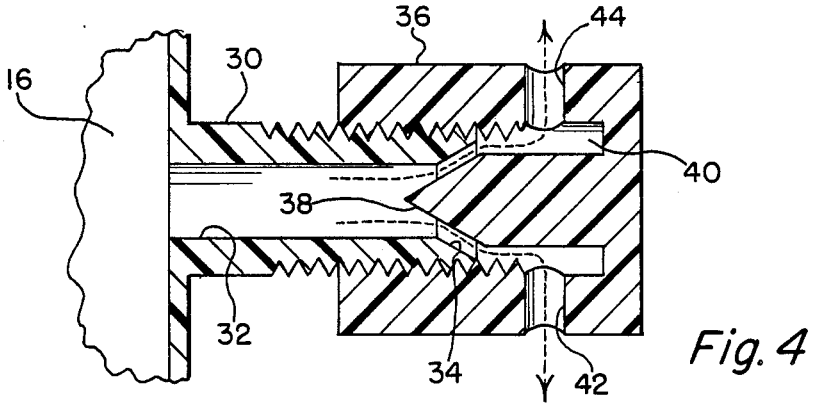
FIG. 4 is a cross sectional view through the adjustable valve showing details of construction and operation.

As shown in FIGS. 2 and 4, the hand operated pump 16 is provided with an outlet nipple 30 having an outlet passage 32. The end of the outlet nipple 30 is provided with a tapered valve seat 34 against which the valve member 38 provided on the valve cap 36 is engagable. The valve cap 36 is threaded onto the outlet nipple 30 and accordingly may be turned in the appropriate direction to move the valve member 38 relative to the valve seat 34 to adjust the valve opening. As shown in FIG. 4, the valve cap 36 is provided with an internal annular clearance space 40 and at least one or, as shown in FIG. 4, two holes 42, 44 communicating with the clearance space 40. As depicted in FIG. 3, the valve cap may be turned in a clockwise direction to advance the cap 36 on the outlet nipple 30 in order to close the valve 38 completely or, alternatively, the cap may be rotated counter-clockwise to withdraw the valve 38 from the valve seat 34 in order to provide different valve openings and thus provide for increasing or decreasing the rate at which air may escape from the bladder through the outlet passage 32, the clearance space 40 and the outlet holes 42, 44. As shown in FIG. 3, if desired, the end of the valve and valve cap can be provided with markings for indicating at least approximate rates of deflation of the bladder 14 depending on where the valve cap is positioned.

In use, the user may either inflate the bladder by blowing directly into the auxiliary inflation tube 24 or by squeezing the hand pump 16. During inflation, it is preferred that the valve cap be turned to completely close the valve 38 to prevent escape of air during inflation, however, the clearance space 40, the holes 42, 44, the outlet passage 32 and the valve clearance are relatively small and, although some air would escape during inflation, the rate of introduction of air into the bladder would substantially exceed the rate of escape of any air with the valve open and it is contemplated that the bladder may still be easily inflated even with the valve open. When inflated to the desired hardness, the user merely adjusts the valve cap 36 to a desired rate of deflation as shown on the scale whereby, the cushion will deflate substantially completely in accordance with the rate set. Advantageously, the user of the cushion may take advantage of the inflated cushion by placing it under his head or other body part as desired and the cushion will automatically deflate to the preferred completely collapsed position in the time set.

Having described the preferred embodiment of the invention, those skilled in the art having the benefit of the description and accompanying drawings, can readily devise other embodiments and modifications and such other embodiments and modifications are to be considered to be within the scope of the appended claims.

What is claimed is:

1. An inflatable cushion comprising:

a bladder having an inlet;

a hand operated air pump having an outlet connected to said inlet of said bladder for inflating said bladder;

means providing for a controlled rate of deflation of said bladder; and means connected to the inlet of said bladder providing for entry of air into said bladder independently of said hand operated pump.

2. The inflatable cushion as defined in claim 1 wherein said means providing for said controlled rate of deflation includes means providing for adjusting the rate of deflation.

3. The inflatable cushion as defined in claim 2 wherein said means providing for said controlled rate of deflation comprises an adjustable valve associated with the inlet into said bladder.

4. The inflatable cushion as defined in claim 3 wherein said adjustable valve is located in an outlet from said hand operated pump.

5. The inflatable device as defined in claim 1 wherein said means providing for entry of said air into said bladder independantly of said hand operated pump includes a tube connected to said inlet into said bladder and a normally closed check valve associated with at least said tube for preventing escape of air from said bladder through said tube.

6. An inflatable cushion comprising;

a bladder having an inlet;

means connected to said inlet for inflating said bladder;

means for setting a controlled rate of deflation of said bladder; and means for inflating said bladder including tube means associated with said inlet into said bladder for introducing an air supply into said bladder independently of said hand operated pump.

7. The inflatable cushion as defined in claim 6 wherein said means for setting said controlled rate of deflation comprises adjustable valve means associated with said inlet.

8. The inflatable cushion as defined in claim 7 wherein said means for inflating said bladder includes a hand operated pump connected to said inlet into said bladder.

9. The inflatable cushion as defined in claim 8 wherein said adjustable valve means is a needle valve connected to said hand operated pump.

10. An inflation cushion comprising;

a bladder in the shape of a pillow, said bladder having an inlet;

a hand operated pump connected to said inlet for introducing air into said bladder;

means for introducing air into said bladder independently of said hand operated pump; and an adjustable discharge valve associated with said hand operated pump for setting and controlling a selected rate of escape of said air from said bladder, whereby said bladder deflates at said controlled rate.

11. The inflatable device as defined in claim 10 wherein said means for introducing said air into said bladder independently of said hand operated pump includes a tube having an inlet and an outlet said outlet connected to said inlet into said bladder and a normally closed check valve associated with said tube, said check valve adapted to close in a direction of air flow in said tube from said bladder toward said inlet into said tube, said check valve adapted to open in a direction of air flow in said tube from said inlet into said tube toward said inlet into said bladder.

* * * * *